US007682139B2

(12) United States Patent
Riley et al.

(10) Patent No.: US 7,682,139 B2
(45) Date of Patent: Mar. 23, 2010

(54) MOTOR AND METHOD OF OPERATING THE SAME

(76) Inventors: Thomas Matthew Riley, 2323 N. Woodlawn, #434, Wichita, KS (US) 67220; Steven Raymond, 06-726 Rd., N-30, Montpelier, OH (US) 43543; Reed Frank, 10791 Pittsford Rd., Pittsford, MI (US) 49271

( * ) Notice: Subject to any disclaimer, the term of this patent is extended or adjusted under 35 U.S.C. 154(b) by 93 days.

(21) Appl. No.: 11/969,313

(22) Filed: Jan. 4, 2008

(65) Prior Publication Data

US 2008/0199341 A1 Aug. 21, 2008

Related U.S. Application Data

(60) Provisional application No. 60/878,620, filed on Jan. 4, 2007.

(51) Int. Cl.
*F03C 4/00* (2006.01)
*F04C 11/00* (2006.01)

(52) U.S. Cl. ..... 418/9; 418/3; 418/5; 418/132; 418/206.1

(58) Field of Classification Search ..... 418/1, 418/3, 5, 9, 11, 132, 206.1, 206.5
See application file for complete search history.

(56) References Cited

U.S. PATENT DOCUMENTS 3,198,120 A * 8/1965 Little, Jr. ..... 418/9
4,934,908 A * 6/1990 Turrell et al. ..... 418/9
5,846,066 A * 12/1998 Troup ..... 418/3
6,129,067 A * 10/2000 Riley ..... 123/246

* cited by examiner

*Primary Examiner*—Theresa Trieu
(74) *Attorney, Agent, or Firm*—Marshall & Melhorn, LLC

(57) ABSTRACT

A motor and a method of operating the motor are described. The motor may have a female rotor shaft having mounted thereon a female compression rotor, a female power rotor, and a spur gear. The motor may also have a male rotor shaft having mounted thereon a male compression rotor, a male power rotor and a power rotor gear. A housing containing the foregoing may have a front housing plate, a compression rotor case, an isolator plate, a power rotor case, a rear housing plate, and a gear cover adjacent the rear housing plate. The various female and male rotors are engaged with one another within the housing.

1 Claim, 20 Drawing Sheets

MOTOR AND METHOD OF OPERATING THE SAME

RELATED APPLICATIONS

This application is claiming the benefit under 35 USC 119(e) from U.S. Patent Application Ser. No. 60/878,620 filed on Jan. 4, 2007 under 35 USC 111(b) which is fully incorporated herein by reference.

FIELD OF THE INVENTION

The invention relates to a motor and a method of operating the motor.

BACKGROUND OF THE INVENTION

Motor are well known devices for providing power to a variety devices. Many motors, however, lack certain operational efficiencies making them expensive to run. For example, some motors will only run on a particular type of energy, such as a fossil fuel. It would be desirable to have one engine that could efficiently operate on a variety of energy sources, including sources that were not fossil fuels.

Many motors also are extremely complex. It would be desirable to have one engine that was relatively simple to manufacture, repair and replace.

The following depicts and describes one embodiment of an engine that overcomes the disadvantages of many of the prior art engines.

SUMMARY OF THE INVENTION

In one embodiment, the motor may have a female rotor shaft having mounted thereon a female compression rotor, a female power rotor, and a spur gear. The motor may also have a male rotor shaft having mounted thereon a male compression rotor, a male power rotor and a power rotor gear. The foregoing may be located within a housing having, in order, a front housing plate, a compression rotor case, an isolator plate, a power rotor case, a rear housing plate, each rotatably receiving therein the female rotor shaft and the male rotor shaft. The housing also may have a gear cover adjacent the rear housing plate.

The female compression rotor and the male compression rotor may be rotatably mounted, and drivingly connected to one another, within a female compression rotor cavity and a male compression rotor cavity, respectively, within the compression rotor case.

The female power rotor and the male power rotor may be rotatably mounted, and drivingly connected to one another, within a female power rotor cavity and a male power rotor cavity, respectively, within the power rotor case.

The spur gear and the power rotor gear may be rotatably mounted, and drivingly connected to one another, within the gear cover.

BRIEF DESCRIPTION OF THE DRAWINGS

The above, as well as other advantages of the present invention, will become readily apparent to those skilled in the art from the following detailed description when considered in the light of the accompanying drawings in which.

DETAILED DESCRIPTION OF THE PREFERRED EMBODIMENT

Figure 1:
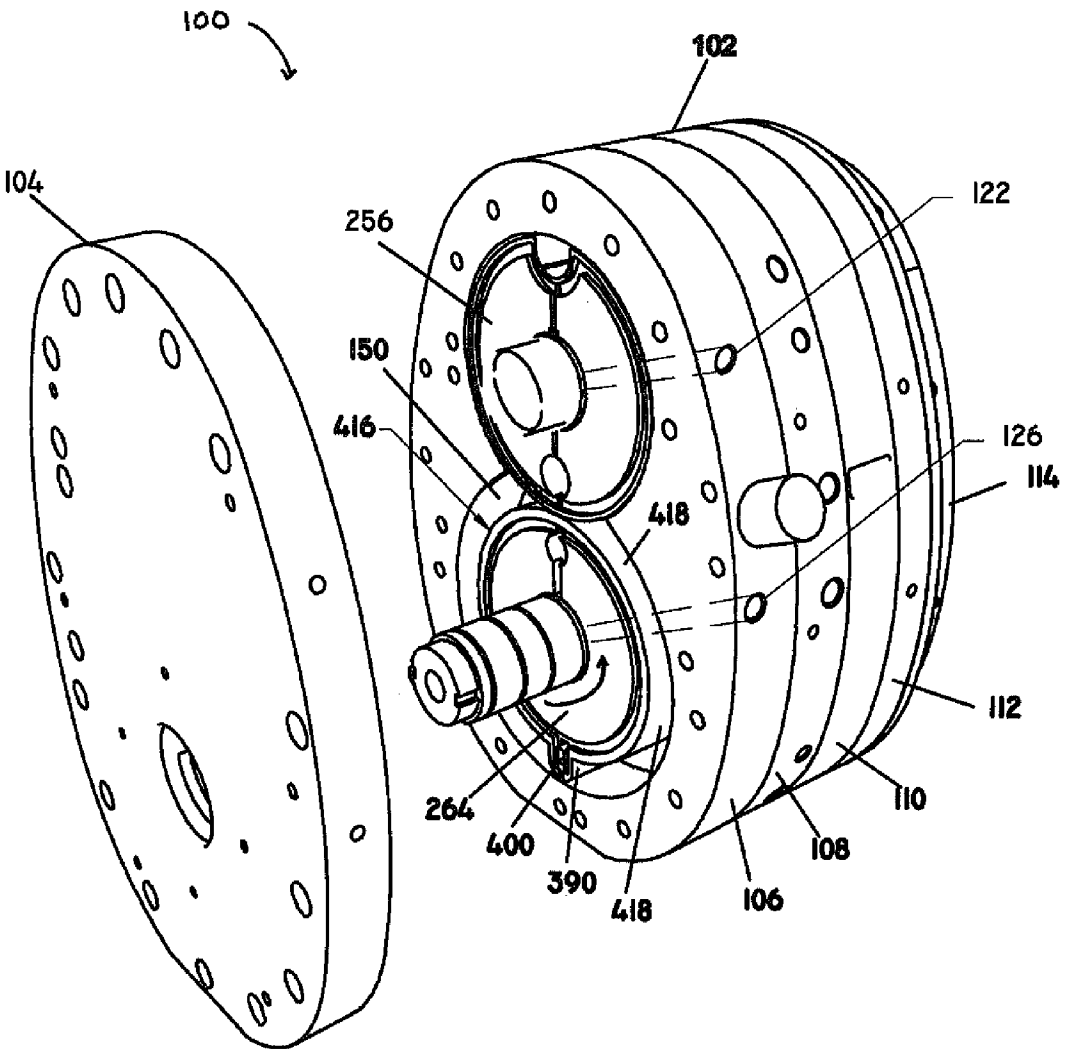
FIG. 1 is a partially exploded perspective view of a schematic embodiment of the invention.
Figure 2:
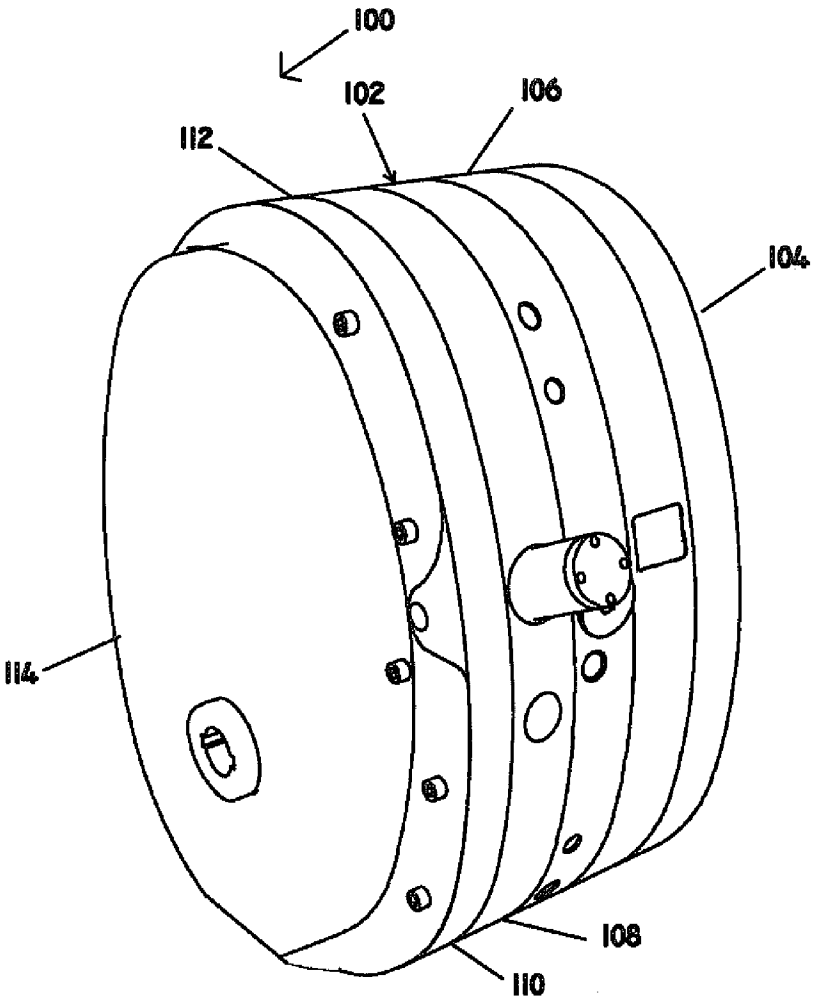
FIG. 2 is an assembled, perspective schematic view of the invention of FIG. 1.
Figure 3:
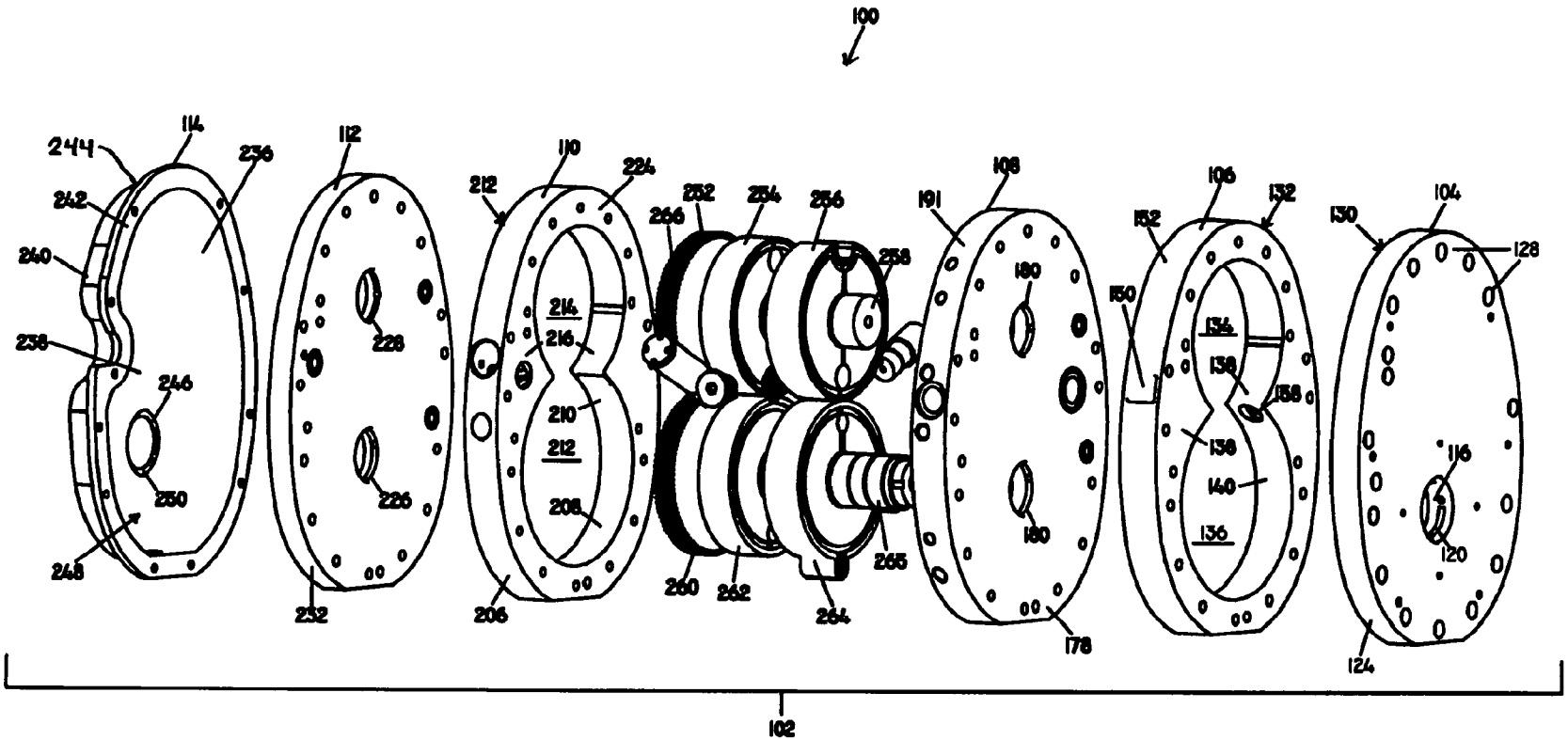
FIG. 3 is an exploded, perspective schematic view of the invention of FIG. 1.
Figure 4:
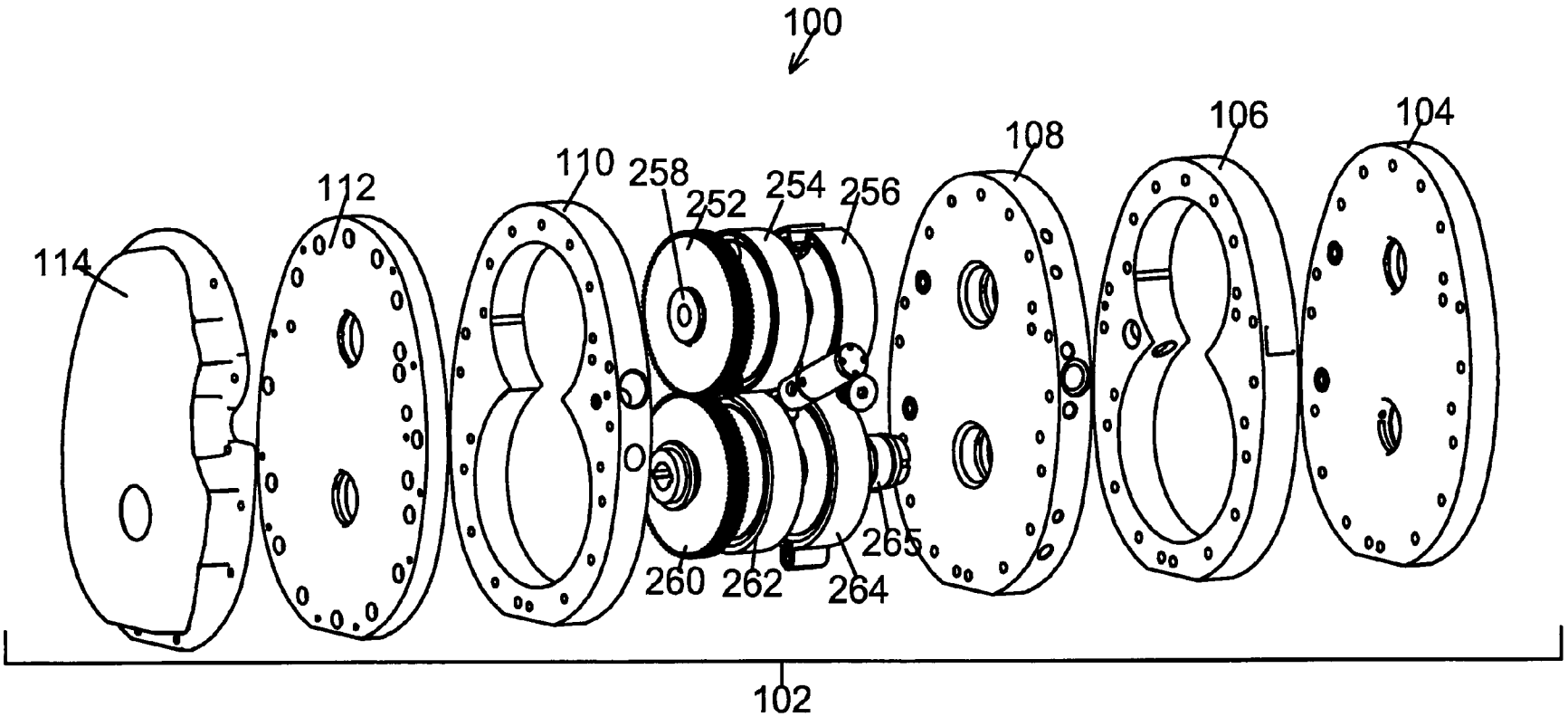
FIG. 4 depicts FIG. 3 from another angle.
Figure 5:
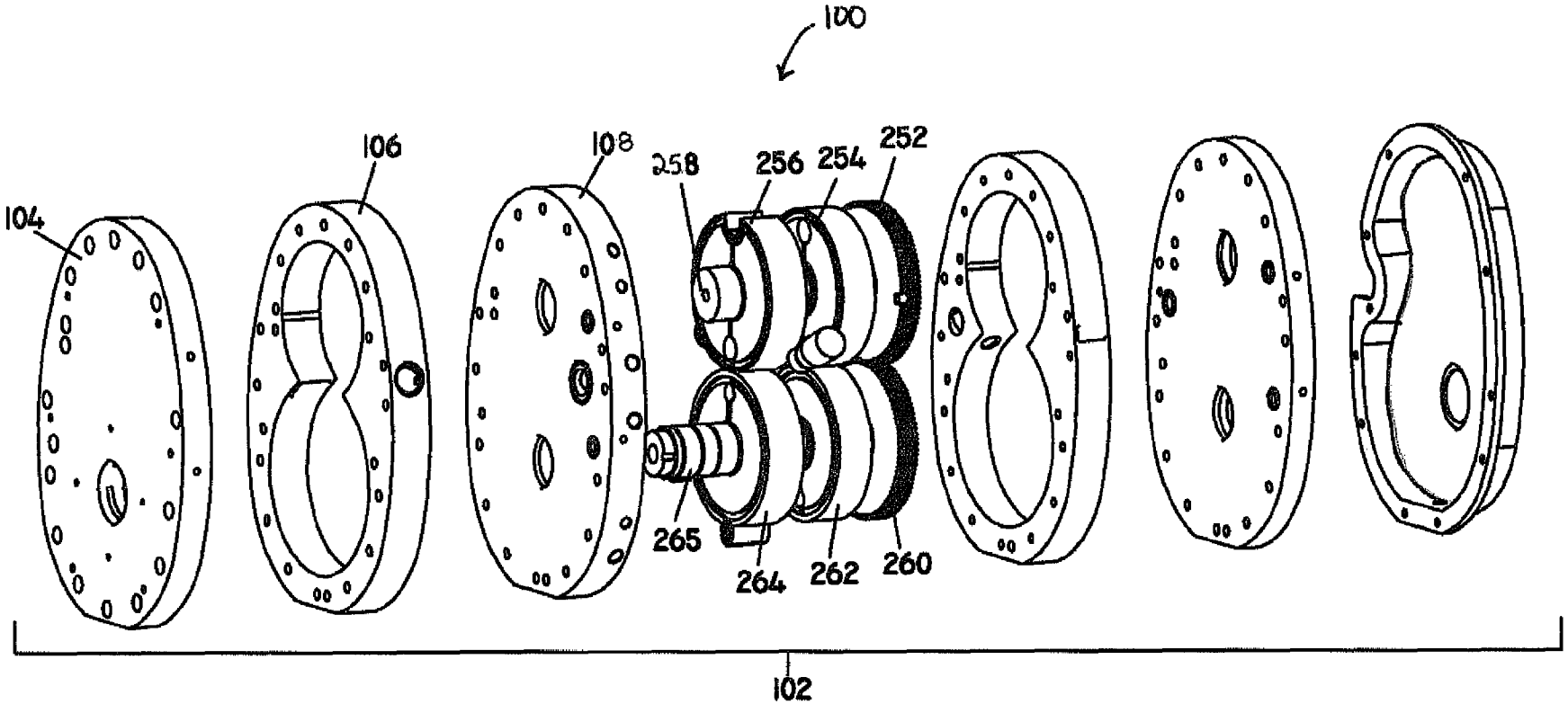
FIG. 5 depicts FIG. 3 from yet another angle.
Figure 6:
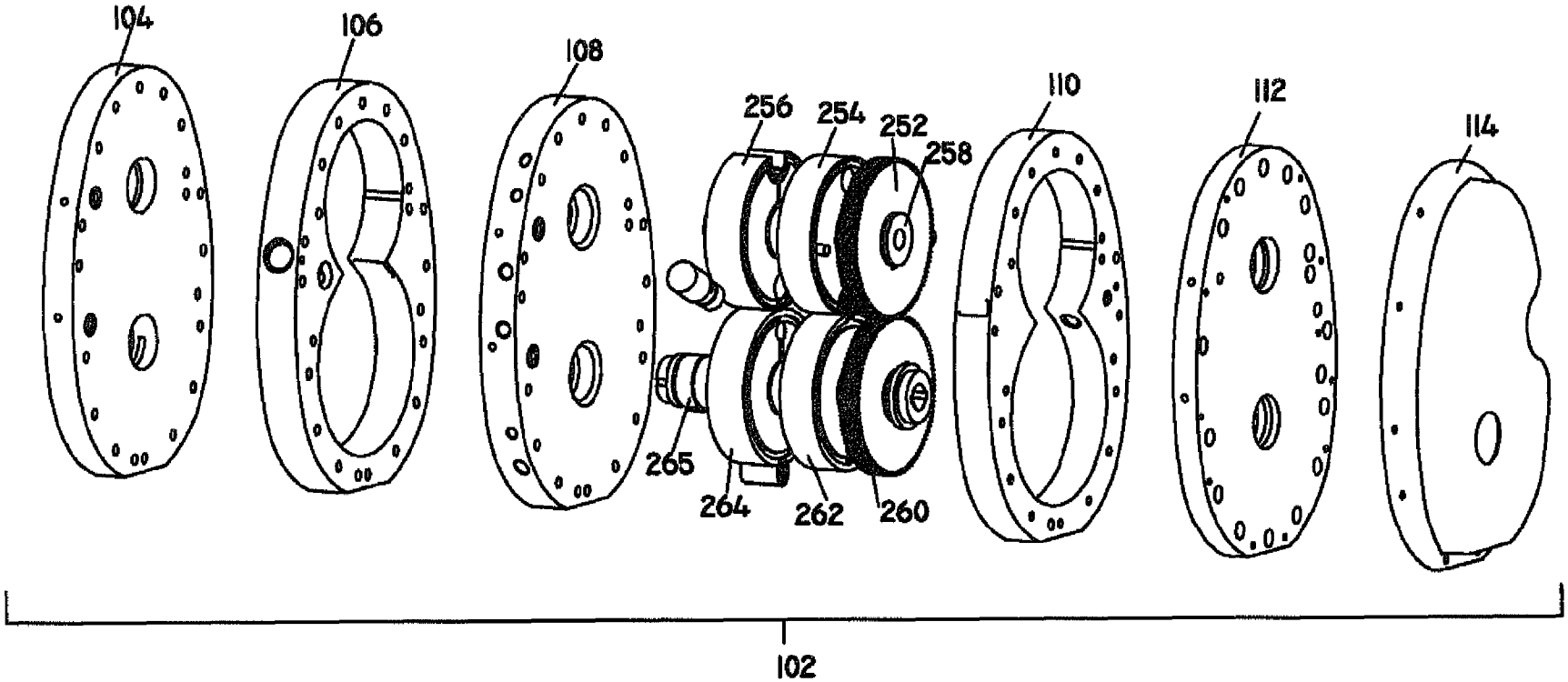
FIG. 6 depicts FIG. 3 from yet another angle.

It is to be understood that the invention may assume various alternative orientations and step sequences, except where expressly specified to the contrary. It is also to be understood that the specific devices and processes illustrated in the attached drawings, and described in the following specification are simply exemplary embodiments of the inventive concepts defined in the appended claims. Hence, specific dimensions, directions or other physical characteristics relating to the embodiments disclosed are not to be considered as limiting, unless the claims expressly state otherwise.

Referring to FIGS. 1-20, a motor 100 has a housing 102 that may be comprised of a front housing plate 104, a compression rotor case 106, an isolator plate 108, a power rotor case 110, a rear housing plate 112 and a gear cover 114. The housing 102 may be generally oval shaped, although other shapes, such as circular or polygons are permissible. The housing 102 may be constructed from metal, such as aluminum, steel or iron, by way of example only, and/or any polymer, such as plastic, and/or composite materials, and/or ceramics.

Figure 7:
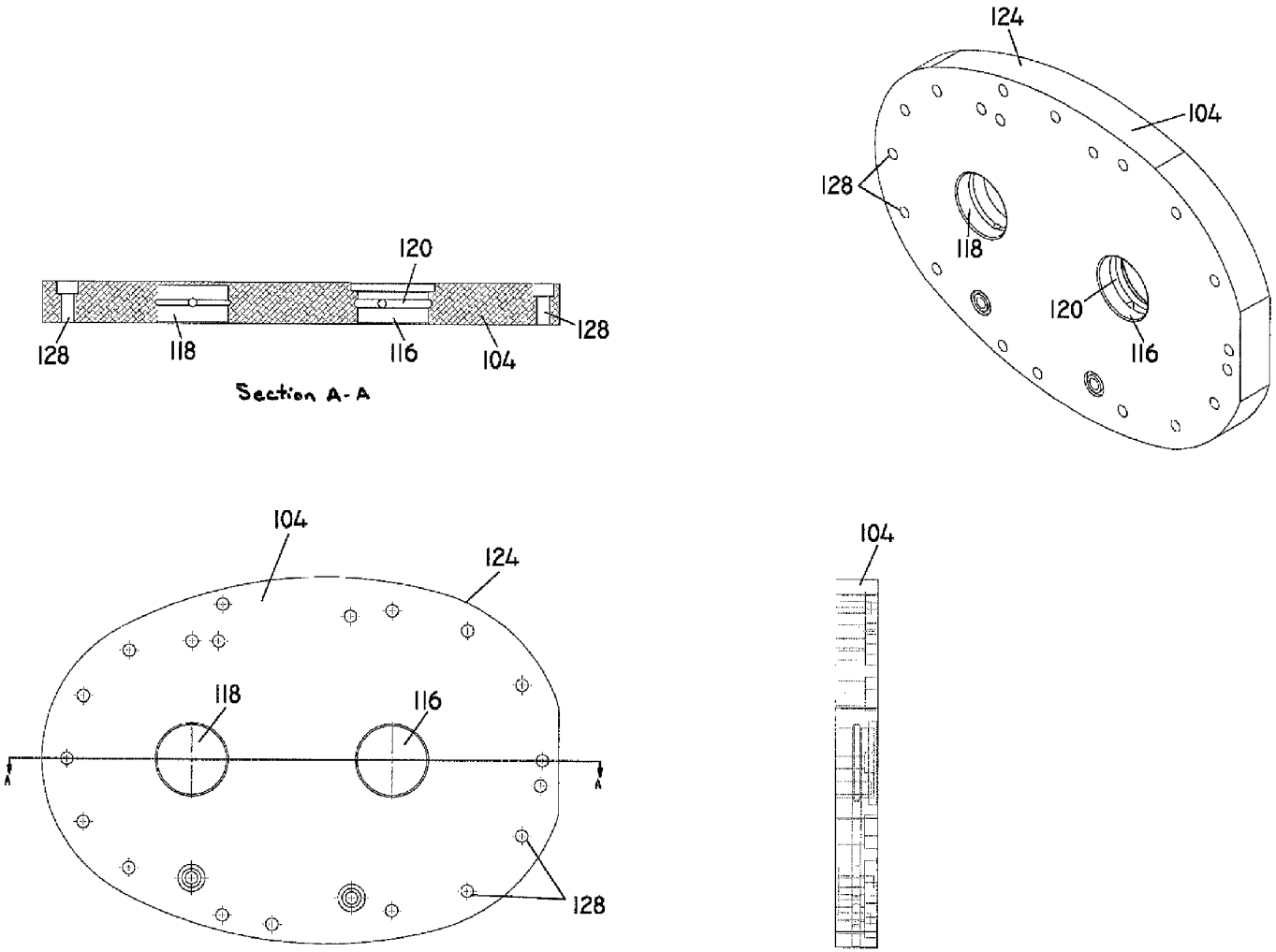
FIG. 7 depicts several views of one component depicted in FIG. 3.

With reference to all the figures and FIG. 7 in particular, it can be seen that the front housing plate 104 defines a male rotor shaft aperture 116 for receiving therethrough a male rotor shaft. The front housing plate 104 also defines a female rotor shaft aperture 118 for receiving therein a female rotor shaft. The shafts are both discussed in more detail below. Both shafts are rotatably mounted within their respective apertures 116, 118. A seal 120 may be located within at least the aperture 116 for the male rotor shaft.

As best seen in FIG. 1, a first oil galley 122 may extend from an exterior surface 124 of the front housing plate 104 to the male rotor shaft aperture 116 and a second oil galley 126 may extend from the same, or a different, exterior surface 124 to the female rotor shaft aperture 118. Both oil galleys 122, 126 direct lubricant (not shown), such as oil, to the shafts from a source (not shown).

Located about the periphery of the front housing plate 104 is a plurality of fastener apertures 128. The fastener apertures 128 receive fasteners, such as bolts, to connect the front housing plate 104 with at least the compression rotor case 106. Preferably, the fasteners extend through the compression rotor case to the isolator plate 108, the power rotor case 110, the rear housing plate 112 and the rear cover 114 to secure them together.

The front housing plate 104 is located adjacent the compression rotor case 106 to at least partially enclose the compression rotor case 106. Preferably, an inboard side 130 of the front housing plate 104 contacts on outboard side 132 of the compression rotor case 104 to close the outboard side 132 of the case 106.

Figure 8:
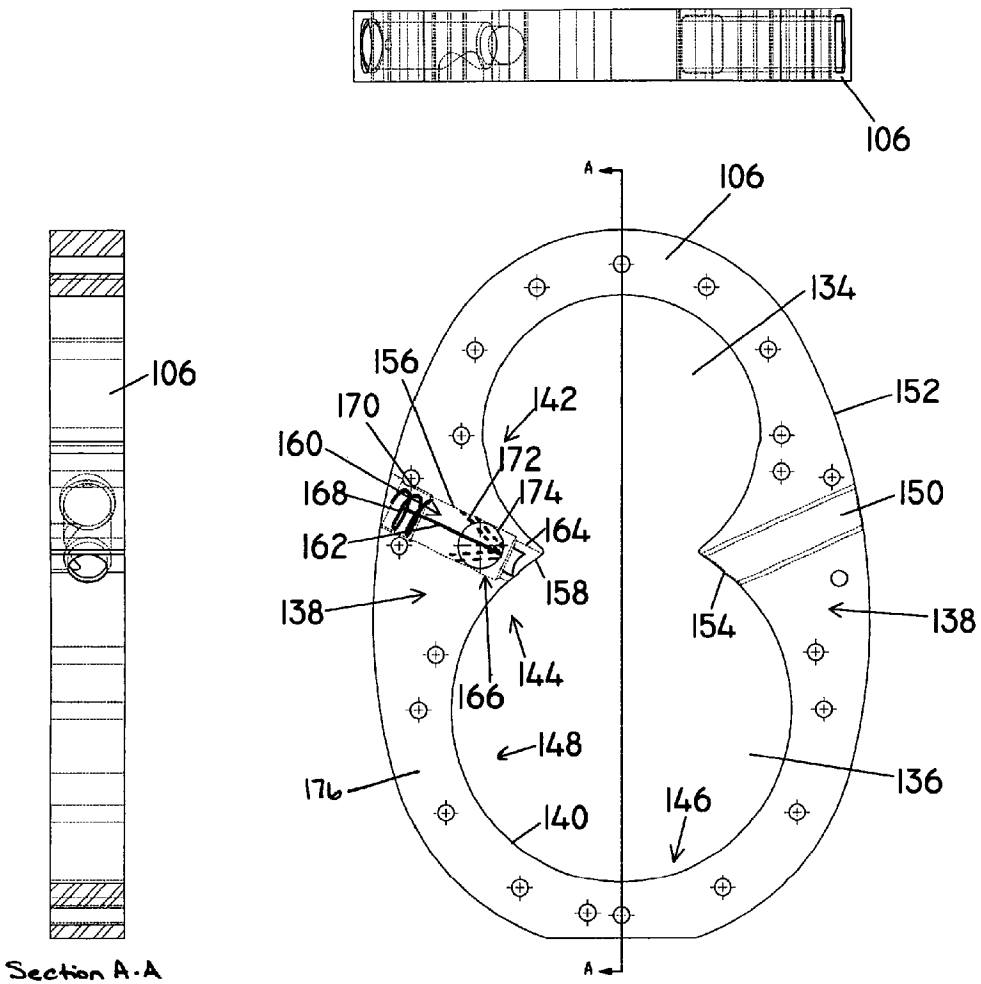
FIG. 8 depicts several views of one component depicted in FIG. 3.
Figure 9:
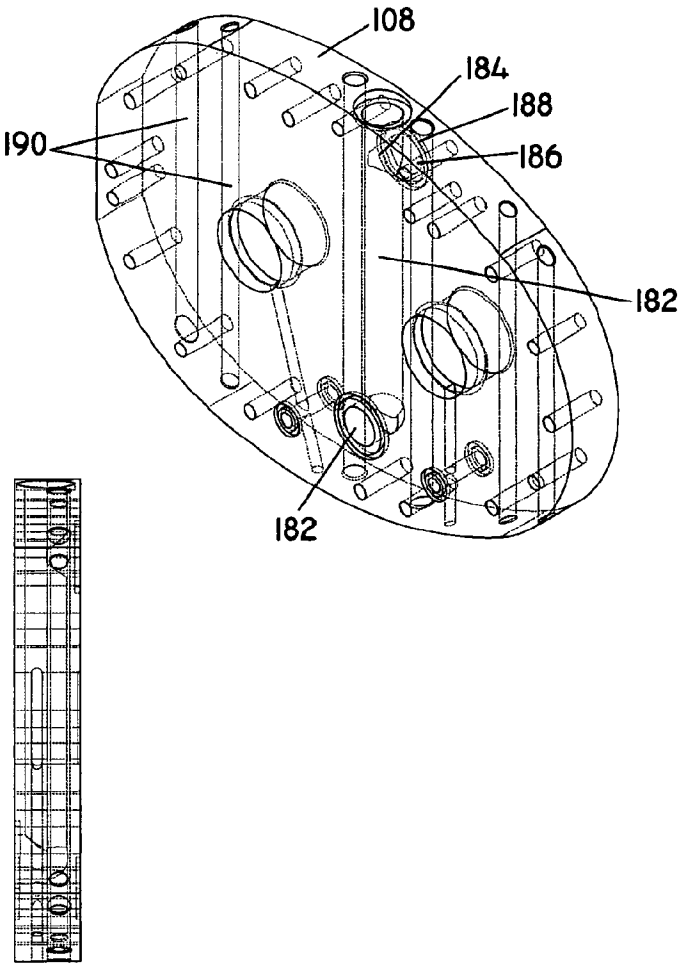
FIG. 9 depicts several views of one component depicted in FIG. 3.
Figure 9:
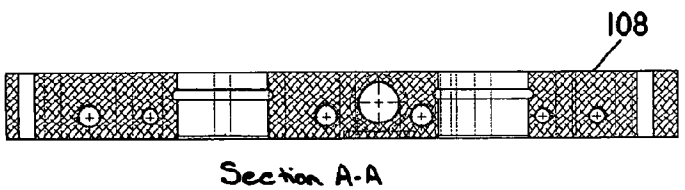
Figure 9:
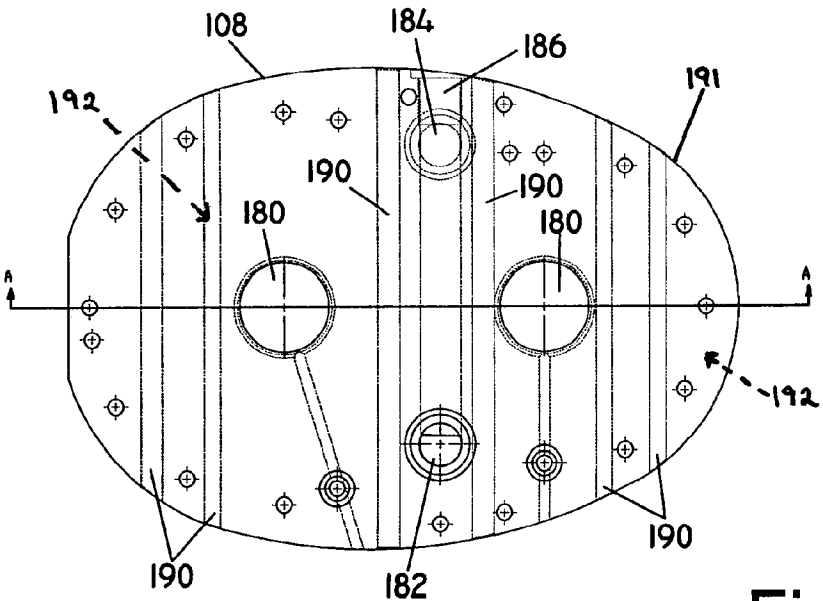
Figure 10:
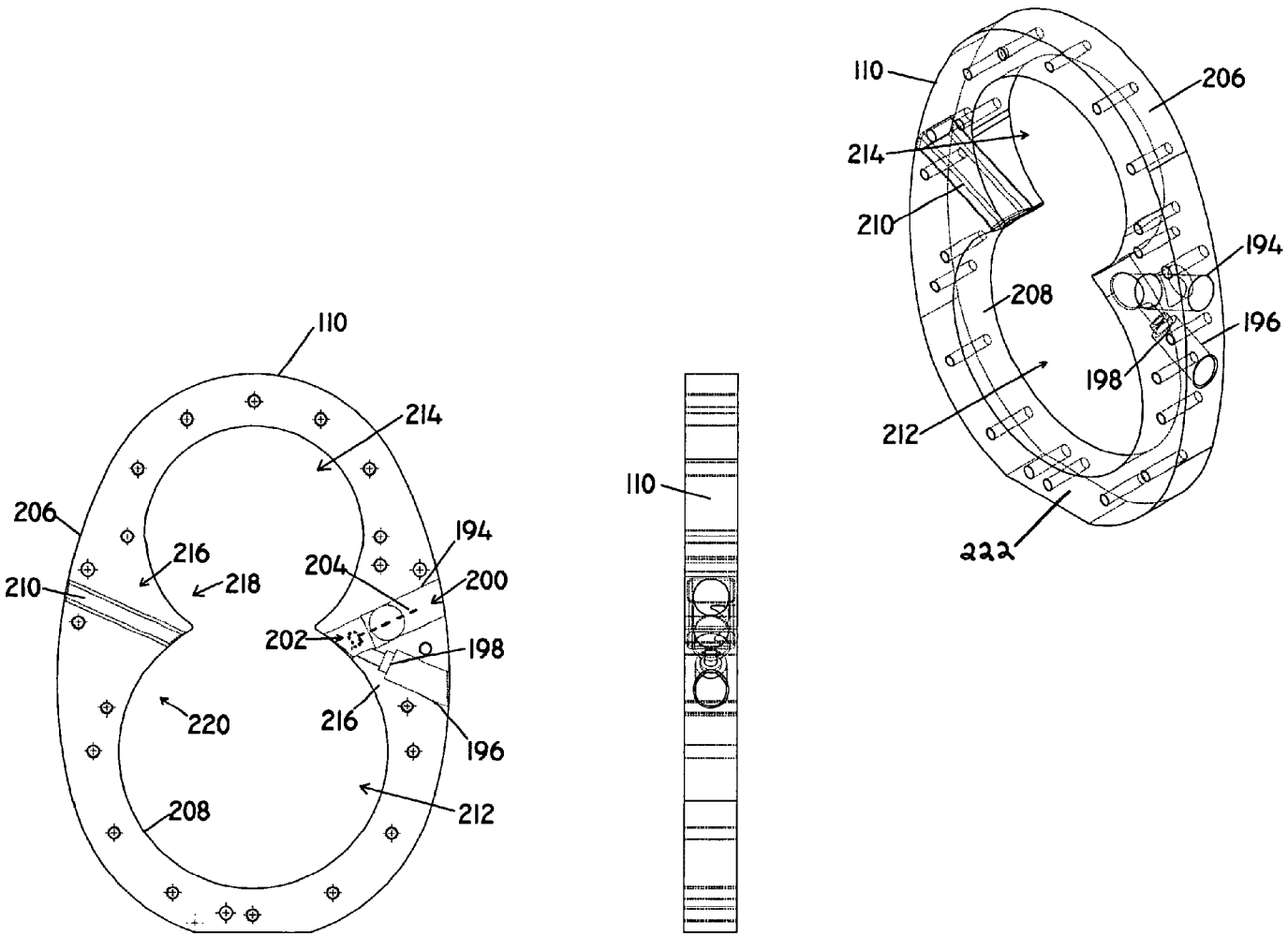
FIG. 10 depicts several views of one component depicted in FIG. 3.

The case 106 defines a female compression rotor cavity 134 and a male compression rotor cavity 136, as shown in the figures as well as FIG. 8. Preferably, the female compression rotor cavity 134 is located above the male compression rotor cavity 136 and the two cavities 134, 136 are in fluid communication with one another. The cavities 134, 136 being arranged as described take on the outline of a figure "8" within the compression rotor case 106.

The compression rotor case 106 may have two inwardly depending projections 138 on an inner surface 140. The projections 138 assist in defining, and at least partially separating, the cavities 134, 136 from one another. The projections 138, however, do not extend to meet one another. Preferably, the projections 138 extend inwardly to define a lower portion 142 of the female compression rotor cavity 134 and an upper portion 144 of the male compression rotor cavity 138. The projections 138 assist in defining the female compression rotor cavity 134 as substantially circular.

The male compression rotor cavity 136 has a base portion 146 and side portions 148 that have substantially equal radii. The upper portion 144 of the male compression rotor cavity 136, however, may have a larger radius than that of the base portion 146 or the side portions 148. As discussed below, the larger radius of the upper portion 144 defines an intake area (see below) and a compression area (see below) between a male compression rotor and the cavity 136.

An intake channel 150 extends from an exterior surface 152 of the compression rotor case 106 to the inner surface 140. Preferably, the intake channel 150 extends through one of the projections 138 to the inner surface 140. The intake channel 150 may extend through the compression rotor case 106 at an angle. Preferably, the intake channel 150 accesses the male compression rotor cavity 136 via an aperture 154 in one of the inwardly depending projections 138. The intake channel 150 may or may not taper from or away from the male compression rotor cavity 136. Additionally, the entrance and/or exit of the channel 150 may or may not have edges that have a radius.

A compression rotor case valve channel 156 extends from the exterior surface 152 of the compression rotor case 106 to the inner surface 140. Preferably, the compression rotor case valve channel 156 is located substantially opposite the intake channel 150 on the case 106. The compression rotor case valve channel 156 may extend at an angle from the exterior surface 152 to the male compression rotor cavity 136. Preferably, the compression rotor case valve channel 156 accesses the male compression rotor cavity 136 via an aperture 158 in one of the inwardly depending projections 138.

A valve 160 is located within the compression rotor case valve channel 156. The valve 160 has a stem 162 and a head 164. The head 164 has a complementary shape to the valve channel 156. The head 164 selectively resides at least partially within a first end portion 166 of the valve channel 156 that is located adjacent, or in, the inner surface 140. The head 164 functions to selectively open and close the valve channel 156. Preferably, one surface of the head 164 is concave. The concave design saves weight in the valve 160.

A spring 168, located within the valve channel 156, selectively biases the head 164 to close the valve channel 156. The spring 168 may be such as a coil spring that is located about the stem 162 of the valve 160 or it may be located behind the stem 162.

Additionally, or alternatively, the valve stem 162 may be connected to a computer controlled solenoid (not shown). The solenoid can be engaged and disengaged to move the valve 160 to selectively open and close the valve channel 156.

A valve stem seat 170 may be connected to the valve channel 156. The valve stem seat 170 may comprise a plurality of channels 172. One channel may selectively receive the valve stem 162 as it reciprocates (described below) and thus function as a lubricant pump. The other channels may converge adjacent the head 164 and vent any excess fluid pressure (pressure from lubricant or air) from the valve channel 156 or permit additional fluid pressure to enter the valve channel 156. By removing excess fluid pressure or adding fluid pressure, the movement of the valve 160 is not undesirably restricted.

The valve channel 156 is in fluid communication with a compression rotor case channel 174. The channel 174 preferably extends substantially perpendicularly from the valve channel 156, although it may extend from the valve channel 156 at any angle.

The compression rotor case 106 is connected to the isolator plate 108. Preferably, an inboard side 176 of the compression rotor case 106 contacts an outboard side 178 of the isolator plate 108 to close the inboard side 176 of the case 106, except as described below. As seen in the figures, including FIG. 9, the isolator plate 108 may have two apertures 180 for receiving the male rotor shaft and the female rotor shaft (both described below) therethrough.

Additionally, the isolator plate 108 has a fluid channel 182 that connects with the channel 174 of the compression rotor case 106. The fluid channel 182 extends substantially across the isolator plate 108. At substantially the opposite side of the isolator plate 108, the fluid channel 182 is connected to a connector channel 184 and a compression port 186. The connector channel 184 is in fluid communication with a connector channel of the power rotor case 110, which is described below.

The compression port 186 may have a rod 188 located therein. The rod 188 may be selectively located within and selectively removed from the compression port 186. It can be appreciated that by locating the rod 188 within the port 186, the volume of the port 186 is decreased. Similarly, when rod 188 is removed from the port 186, the volume of the port 186 increases. The rod 188 may be moved into and out of the port 186 by a motor or a solenoid (not shown), both of which are controlled by a computer (not shown). The motor 100 works equally well without a rod 188 being located in the port 186. In that case, a plug (not shown) is used to seal off the port (186). It can be appreciated that by changing the volume of the port 186, the compression ratio of the motor 100 changes, thus permitting various fuels to be used, such as biodiesel, hydrogen, regular diesel, and/or automobile fuel.

Cooling channels 190 may extend from an exterior surface 191 of the isolator plate 108 to an inner portion 192 of the isolator plate 108. Coolant may selectively flow into and out of the channels 190 to maintain the motor 100 at a predetermined temperature.

The power rotor case 110 is located adjacent the isolator plate 108. While shown in most all the figures, the case 110 is depicted in particular in FIG. 10. The connector channel 184 of the isolator plate 108 is in communication with a power valve sleeve 194. A spark plug channel 196 may be located in communication with the power valve sleeve 194. As shown in the figures, the spark plug channel 196 may be located below the power valve sleeve 194 in the power rotor case 110. The spark plug channel 196 may intersect with the power valve sleeve 194 at an angle. The spark plug channel 196 may have located therein one or more spark plugs, or one or more fuel injector spark plug combination devices 198.

A Hall effect sensor (not shown) preferably is located adjacent the spark plug channel 196. The sensor is connected to a computer (not shown). The computer is connected to the spark plug or spark plug fuel injector combination device 198.

A valve 200 is located within the power valve sleeve 194. The valve 200 has a head portion 202 and a body portion 204. The valve 200 is connected to a solenoid (not shown), preferably by the body portion 204 of the valve 200. The solenoid causes the valve 200 to selectively move within the power valve sleeve 194. One or more sensors (not shown) may be connected to the valve 200 to provide a position reading of the valve 200 within the sleeve 194.

The power valve sleeve 194 extends from an exterior surface 206 of the power rotor case 110 to an inner surface 208 of the case 110. The inner surface 208 of the power rotor case 110 has projections (discussed below) through which the sleeve 194 may extend.

The head portion 202 preferably has a concave shape. It can be appreciated that the concave shape saves weight in the valve 200.

Opposite the power valve sleeve 194, an exhaust channel 210 extends from a male power rotor cavity 212 to the exterior surface 206 of the power rotor case 110. Preferably, the exhaust channel 210 extends from a projection (discussed below). The exhaust channel 210 may be at an angle. The exhaust channel 210 may be approximately opposite the power valve sleeve 194.

The power rotor case 110 defines a female power rotor cavity 214 and the male power rotor cavity 212. Preferably, the female power rotor cavity 214 is located above the male power rotor cavity 212 and the two cavities 212, 214 are in fluid communication with one another. The cavities 212, 214 are substantially circular, and being arranged as described, take on the outline of a figure "8" within the power rotor case 110.

The power rotor case 110 may have two inwardly depending projections 216 on the inner surface 208. The projections 216 assist in defining, and at least partially separating, the cavities 212, 214 from one another. The projections 216, however, do not extend to meet one another. Preferably, the projections 216 extend inwardly to define a lower portion 218 of the female rotor cavity 214 and an upper portion 220 of the male rotor cavity 212.

The rear housing plate 112 is located adjacent the power rotor case 110. More specifically, the rear housing plate 112 in contact with an outboard side 222 of the power rotor case. An inboard side 224 of the power rotor case 110 is in contact with the isolator plate 108. It can be appreciated that the cavities 212, 214 of the power rotor case 110 are laterally enclosed by the cases 106, 110.

Figure 11:
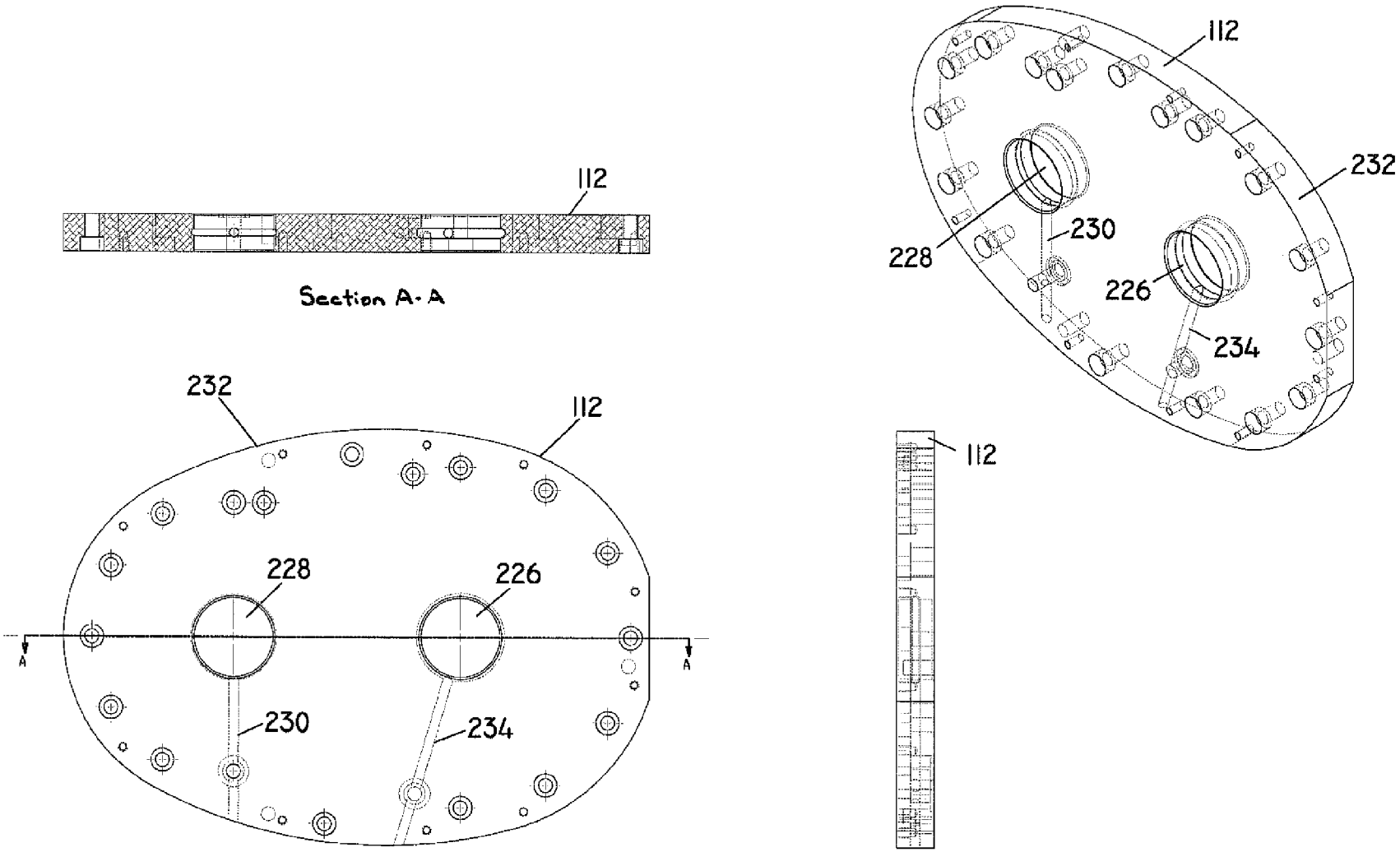
FIG. 11 depicts several views of one component depicted in FIG. 3.
Figure 12:
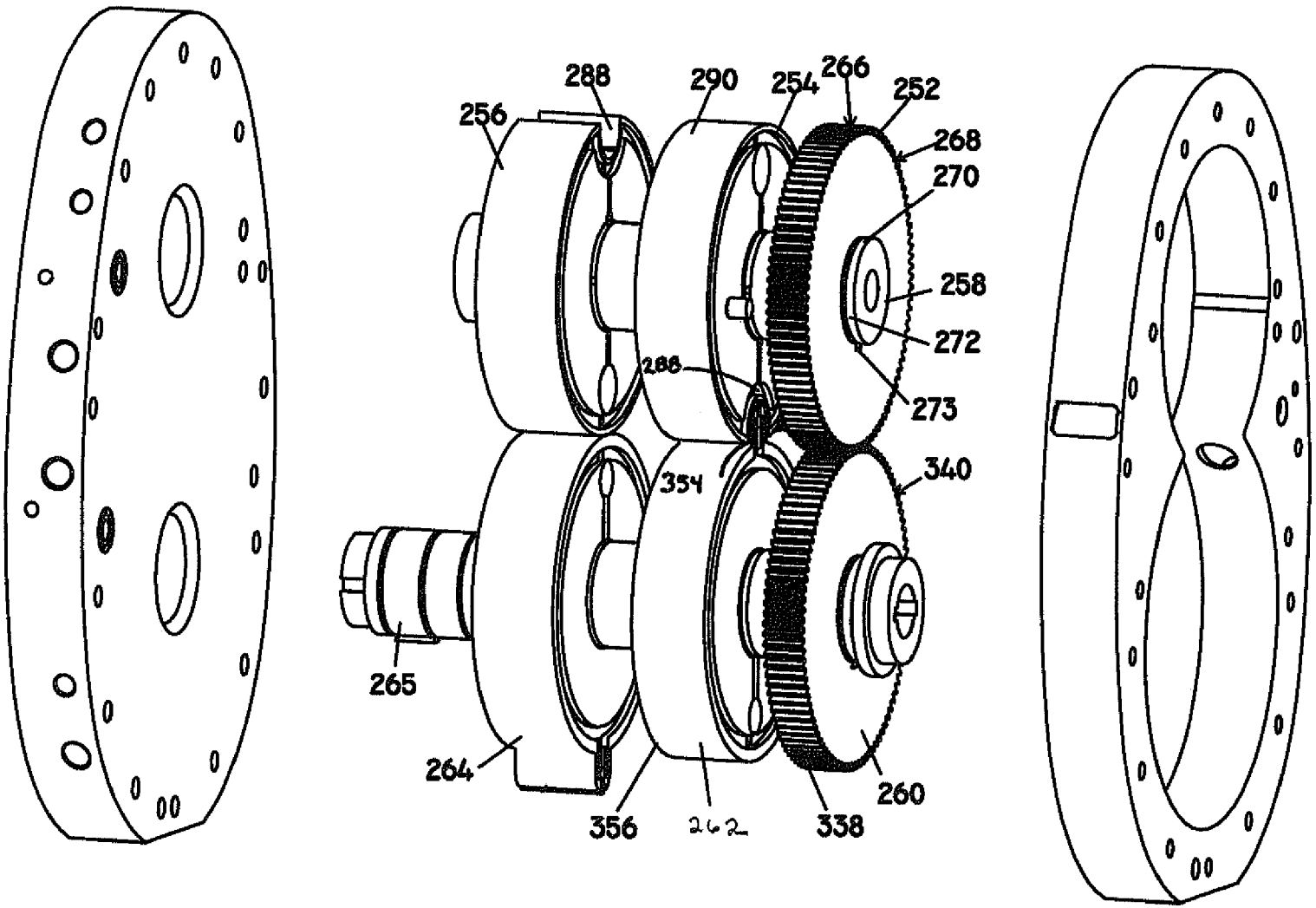
FIG. 12 depicts a magnified view of certain components depicted in FIG. 3
Figure 13:
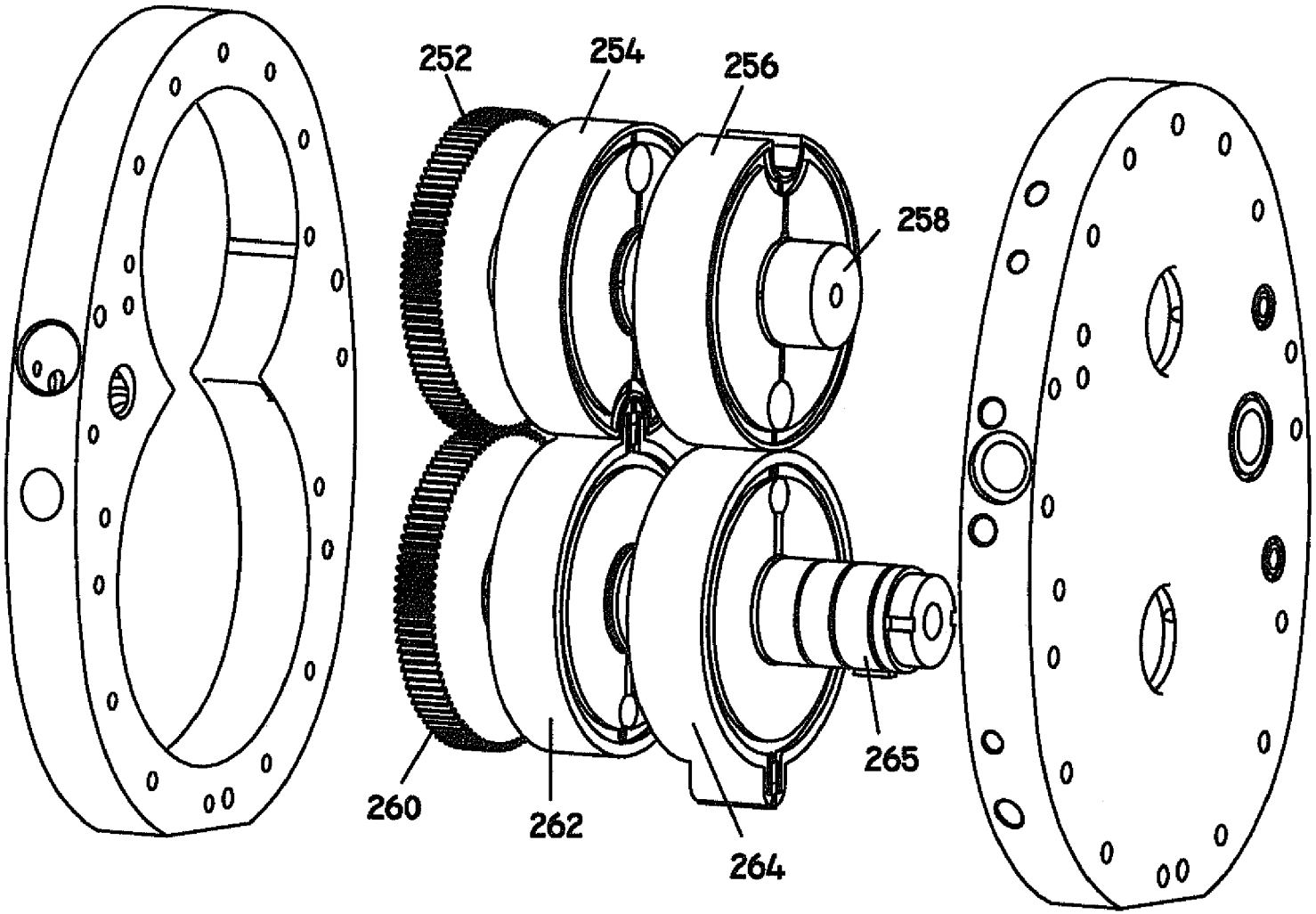
FIG. 13 depicts FIG. 12 from another angle.

As best seen in FIG. 11, the rear housing plate 112 defines a male rotor shaft aperture 226 for receiving therein the male rotor shaft. The rear housing plate 112 also defines a female rotor shaft aperture 228 for receiving therein a female rotor shaft.

A first oil galley 230 may extend from an exterior wall 232 of the rear housing plate 112 to the female rotor shaft aperture 228. A second oil galley 234 may extend from the same exterior wall 232 to the male rotor shaft aperture 226. While the galleys 230, 234 are depicted as extending from the same exterior wall 232 of the rear housing plate 112, it is permissible for them to be located anywhere on the exterior wall 232.

The gear cover 114 is located adjacent the rear housing plate 112. The gear cover 114 defines a cavity 236 for receiving gears, which are described in more detail below, therein. The gear cavity 236 is defined by an end wall 238 and a side wall 240 that axially depends from the end wall 238. Preferably, a fastener flange 242 extends about an exterior surface 244 of the side wall 240. The fastener flange 242 preferably extends continuously about the exterior surface 244 of the side wall 240, however, it need not extend continuously as long as the fastener flange 242 is robustly attached to the side wall 240.

Preferably, an aperture 246 may be located in a lower portion 248 of the end wall 238 of the gear cover 114. A seal 250 may be located in the aperture 246. A portion of a male rotor shaft, which is discussed in more detail below, may at least partially extend through the aperture 246.

As shown, particularly in FIGS. 3-6 and 12-13, a spur gear 252, a female power rotor 254 and a female compression rotor 256, all located on a female rotor shaft 258, may be located within the housing 102. Additionally, a power rotor gear 260, a male power rotor 262 and a male compression rotor 264, all located on a male rotor shaft 265, may be located within the housing 102.

The spur gear 252 has a plurality of teeth 266 on an outer surface 268 thereof. An inner surface 270 of the spur gear 252 defines an aperture 272 for receiving the female rotor shaft 258. The spur gear 252 may be attached to the female rotor shaft 258 by engaging a key 273 (see FIG. 14) on the inner surface 276 with the shaft 258, or vice versa. The spur gear 252 is located within the gear cover 114 and free to rotate therein.

Figure 14:
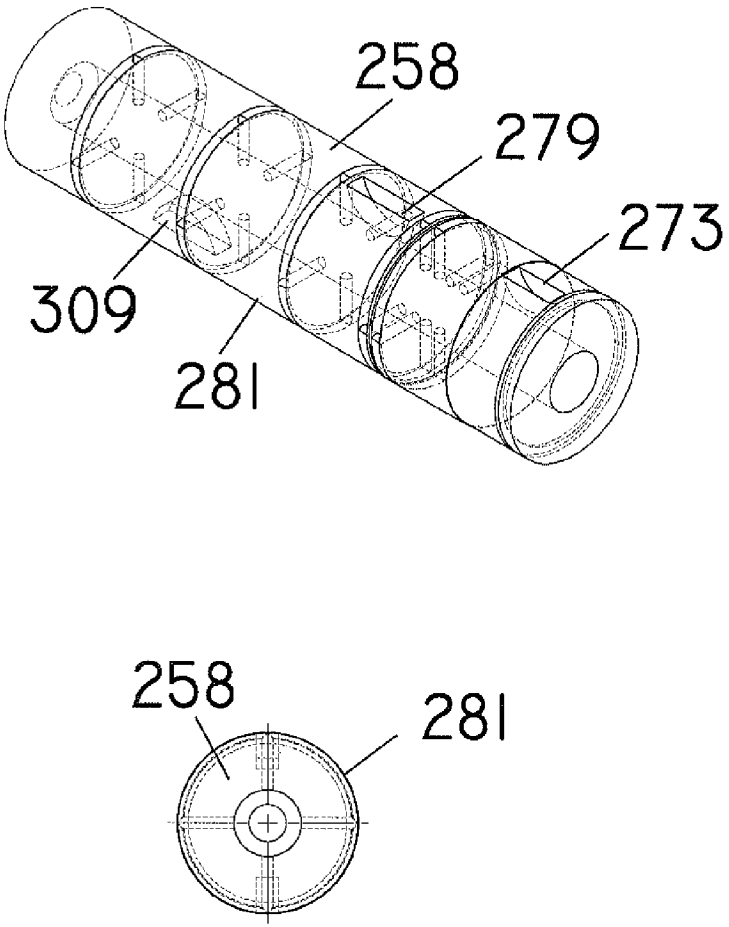
FIG. 14 depicts several views of one component depicted in FIGS. 12 and 13.
Figure 14:
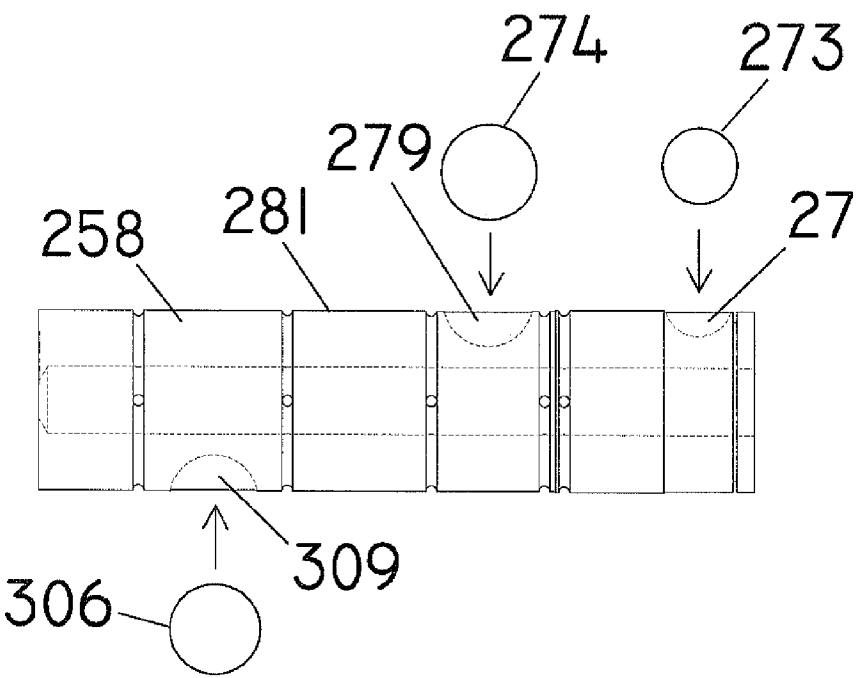
Figure 16:
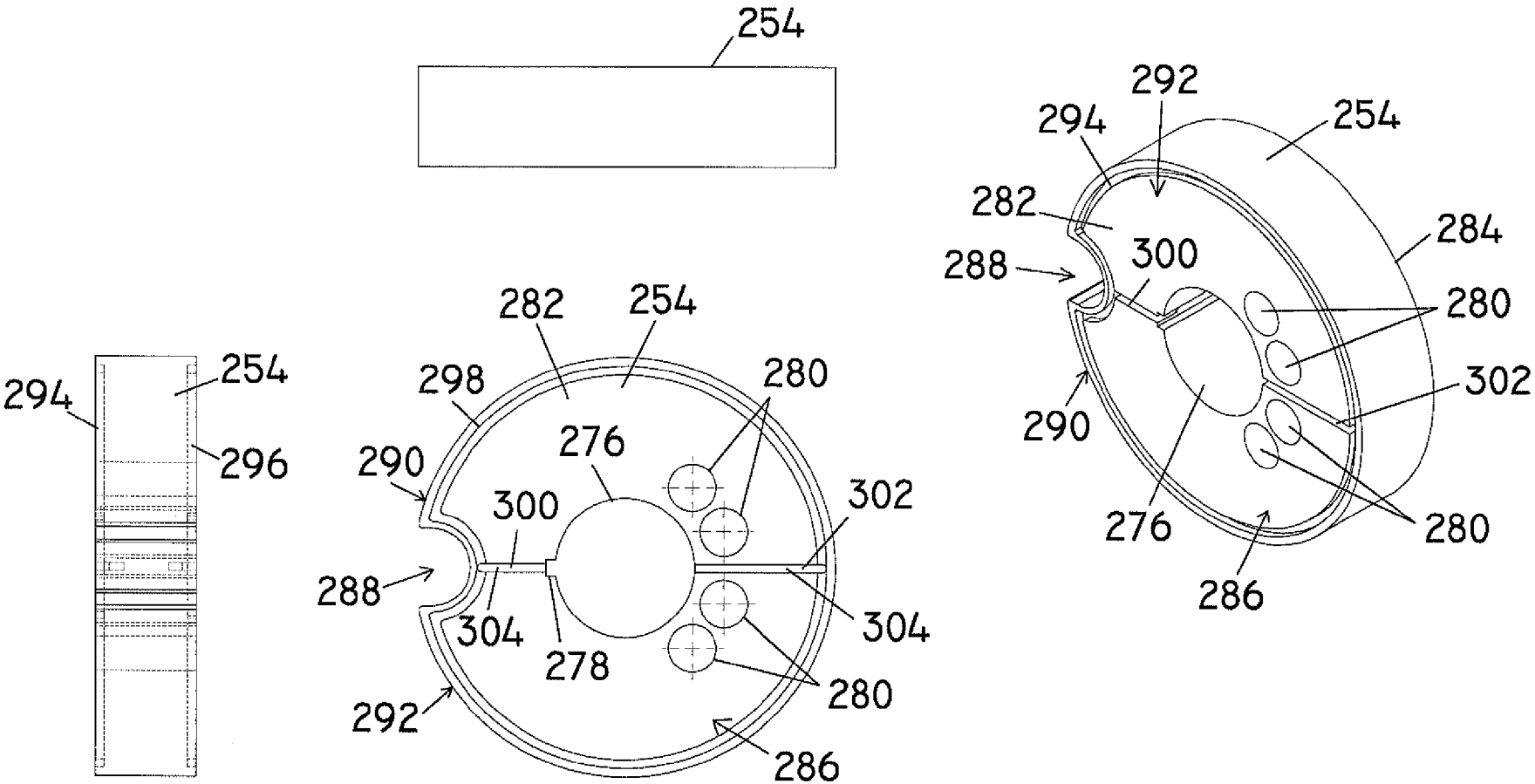
FIG. 16 depicts several views of one component depicted in FIG. 3.

As can be seen in FIGS. 14 and 16, the female power rotor 254 is secured to the female rotor shaft 258 with at least one key 274. The key 274 is located within a keyway 278 located on an inner surface 276 of the female power rotor 254 and a keyway 279 located on an outer surface 281 of the female rotor shaft 258. Additional keys and keyways are with in the scope of the present invention.

The female power rotor 254 defines a plurality of channels 280 extending from a first side 282 of the rotor 254 to a second side 284 of the rotor 254. The channels 280 preferably are located on a first half 286 of the rotor 254. The channels 280 function to balance the rotor 254 as the rotor 254 defines a cavity 288 in its outer perimeter 290 on a second half 292 of the rotor 254.

The cavity 288 may be approximately semi-circular in shape. The cavity 288 preferably selectively receives a blade on the male power rotor 262, both of which are described in more detail below.

The female power rotor 254 is located within the female power rotor cavity 214 of the power rotor case 110. The rotor 254 is free to rotate within the case 110.

A first lubricant channel 294 extends about the outer perimeter 290 of the first side 282 of the female power rotor 254. A second lubricant channel 296 extends about the outer perimeter 290 of the second side 284 of the female power rotor 254. Both lubricant channels 294, 296 extend about the cavity 288 on their respective sides 282, 284. One or more seals 298 are located in both lubricant channels.

A third lubricant channel 300 extends from the first lubricant channel 294 adjacent the cavity 288 and extends to the keyway 278. A fourth lubricant channel 302 extends from the inner surface 276 of the female power rotor 254 to the periphery channel 294 substantially opposite the cavity 288. At least one seal 304 is located in both the third and fourth lubricant channels 300, 302.

The second side 284 of the female power rotor 254 has similar lubricant channels and seals.

Figure 17:
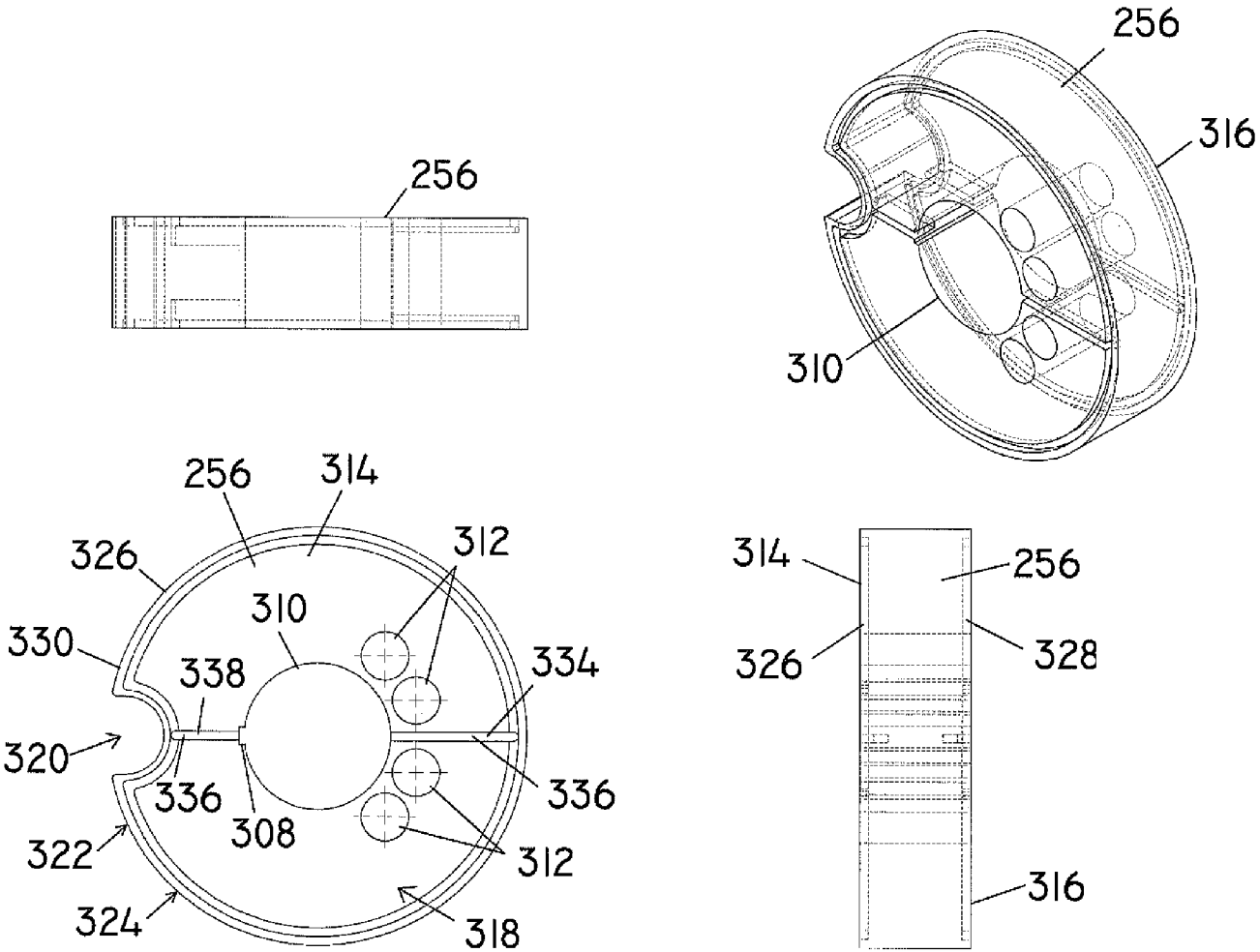
FIG. 17 depicts several views of one component depicted in FIG. 3.

The female compression rotor 256 may also be secured to the female rotor shaft 258 with at least one key. As seen in FIGS. 14 and 17, a key 306 extends into a keyway 308 located on an inner surface 310 of the female compression rotor 256 and also into a keyway 309 on the outer surface 281 of the female rotor shaft 258.

The female compression rotor 256 defines a plurality of channels 312 extending from a first side 314 of the rotor 256 to a second side 316 of the rotor 256. The channels 312 preferably are located on a first half 318 of the rotor 256. The channels 312 function to balance the rotor 256 as the rotor 256 defines a cavity 320 in its outer perimeter 322 on a second half 324 of the rotor 256.

The cavity 320 may be approximately semi-circular in shape. The cavity 320 preferably selectively receives a blade on the male compression rotor 264, both of which are described in more detail below.

The female compression rotor 256 is located within the female compression rotor cavity 320 of the compression rotor case 106. The rotor 256 is free to rotate within the case 106.

A first lubricant channel 326 extends about the outer perimeter 322 of the first side 314 of the female compression rotor 256. A second lubricant channel 328 extends about the outer perimeter 322 of the second side 316 of the female compression rotor 256. Both lubricant channels 326,328 extend about the cavity 320 on their respective sides 314,316. At least one seal 320 is located in both lubricant channels 326,328.

A third lubricant channel 332 extends from the first lubricant channel 326 adjacent the cavity 320 and extends to the keyway 308. A fourth lubricant channel 334 extends from the inner surface 310 of the female compression rotor 256 to the outer perimeter channel 326 substantially opposite the cavity 320. At least one seal 336 is located in both the third and fourth lubricant channels 332, 334.

The second side 316 of the female compression rotor 256 has similar channels and seals.

Figure 15:
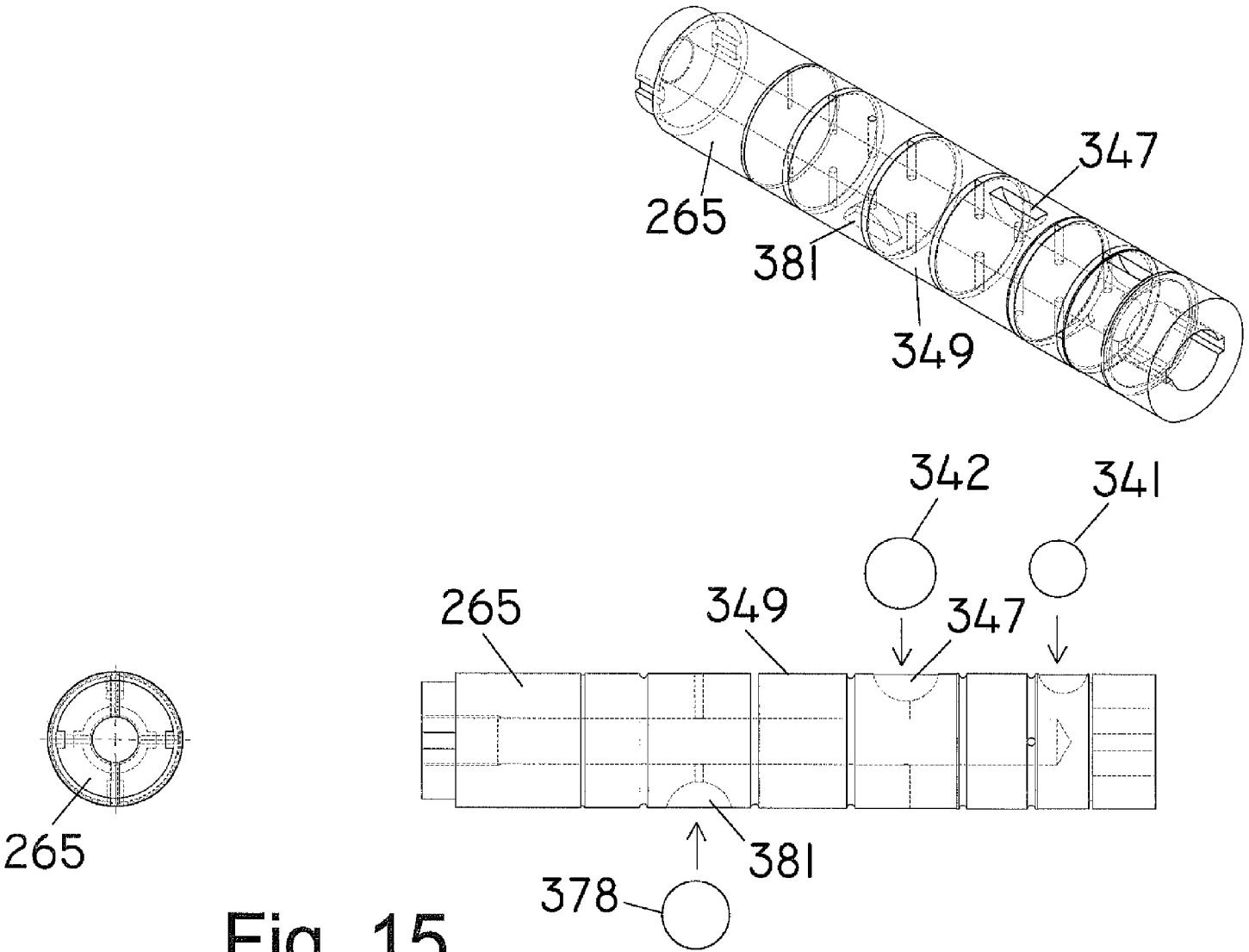
FIG. 15 depicts several views of one component depicted in FIGS. 12 and 13.

As seen in FIGS. 3-6 and 12-13, the power rotor gear 260, located in the gear cover 114, is meshed with the spur gear 252. More specifically, the plurality of teeth 266 on the outer surface 268 of the spur gear 252 are meshed with a plurality of teeth 338 on an outer surface 340 of the power rotor gear 260. The power rotor gear 260 rotates on the male rotor shaft 265. It can be appreciated that the male rotor shaft 265 and the female rotor shaft 258 are synchronized with one another through the spur gear 252 and the power rotor gear 260. The power rotor gear 260 may be connected to the male rotor shaft 265 with a key 341, as shown in FIG. 15.

Figure 18:
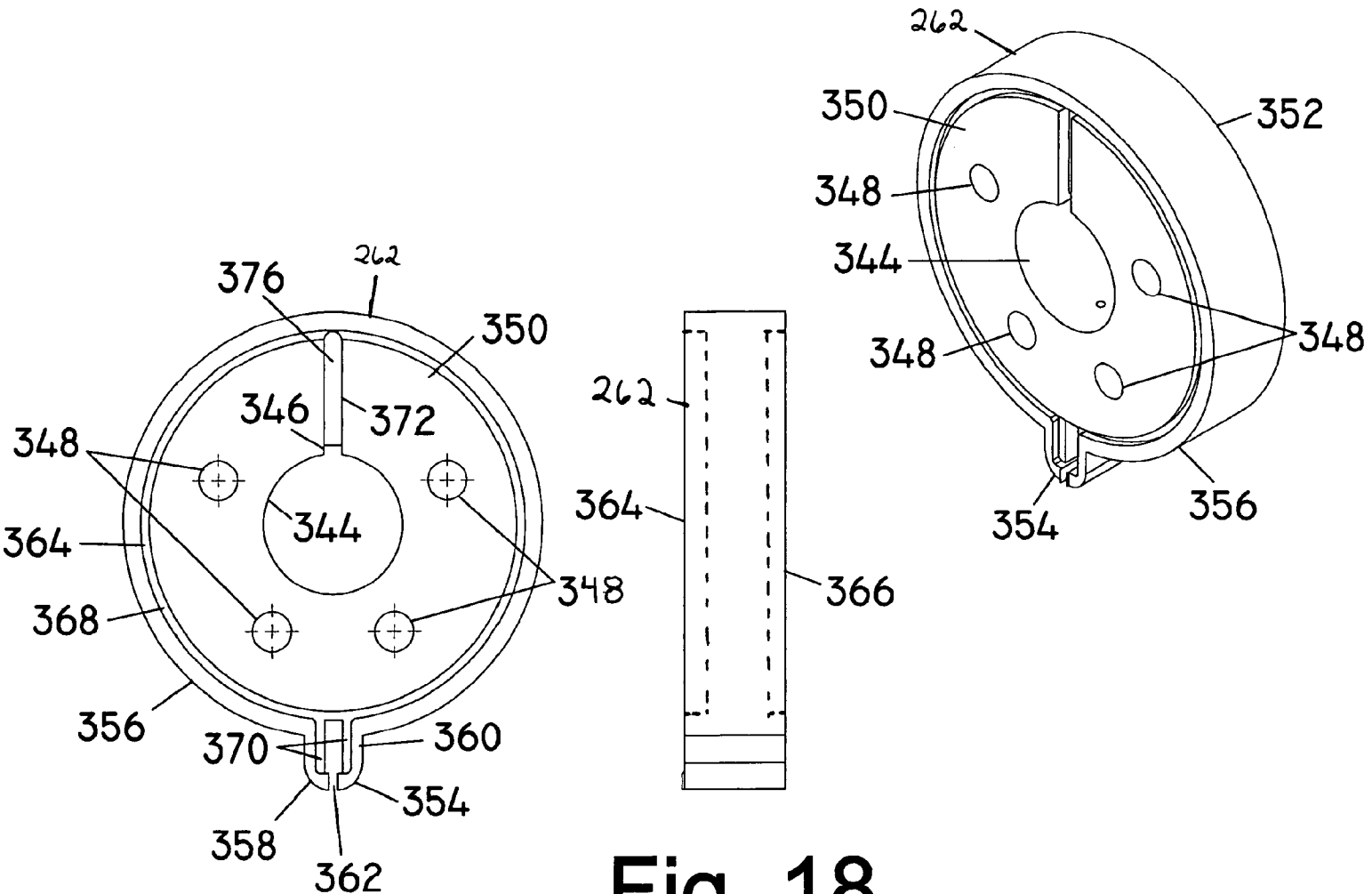
FIG. 18 depicts several views of one component depicted in FIG. 3.

The male power rotor 262 rotates with the male rotor shaft 265 within the male power rotor cavity 212 of the power rotor case 110. The male power rotor 262 is secured to the male rotor shaft 265 with at least one key. As shown in FIGS. 15 and 18, a key 342 is located in a keyway 346 located on an inner surface 344 of the male power rotor 262 and in a keyway 347 on an outer surface 349 of the male rotor shaft 265. Additional keys and keyways are with in the scope of the present invention.

The male power rotor 262 defines a plurality of channels 348 extending from a first side 350 of the rotor 262 to a second side 352 of the rotor 362. The channels 348 preferably are distributed about the rotor 262. The channels 348 function to balance the rotor 262 as the rotor 262 defines a blade 354 in its outer perimeter 356. The blade 354 meshes with the cavity 288 of the female power rotor 254.

The blade 354 has a curvilinear first upstanding portion 358 and a curvilinear second upstanding portion 360. The upstanding portions 358, 360 define between them a cavity 362.

A first lubricant channel 364 extends about the outer perimeter 356 of the first side 350 of the male power rotor 262. A second lubricant channel 366 extends about the outer perimeter 356 of the second side 352 of the male power rotor 262. At least one seal 368 is located in both lubricant channels 364, 366.

The seal 368 preferably has two prongs 370. The prongs 370 extend into the cavity 362 defined by the upstanding portions 358, 360 of the blade 354.

A third lubricant channel 372, on the first side 350, extends from the first lubricant channel 364, preferably approximately opposite the blade 354, to the inner surface 344 of the male power rotor 262. A fourth lubricant channel 374, on the second side 352, extends from the second lubricant channel 266, also preferably approximately opposite the blade 354, to the inner surface 344 of the male power rotor 262. The inner surface 344 accepts the male rotor shaft 265. At least one seal 376 is located in both the third and fourth lubricant channels 372, 374.

Figure 19:
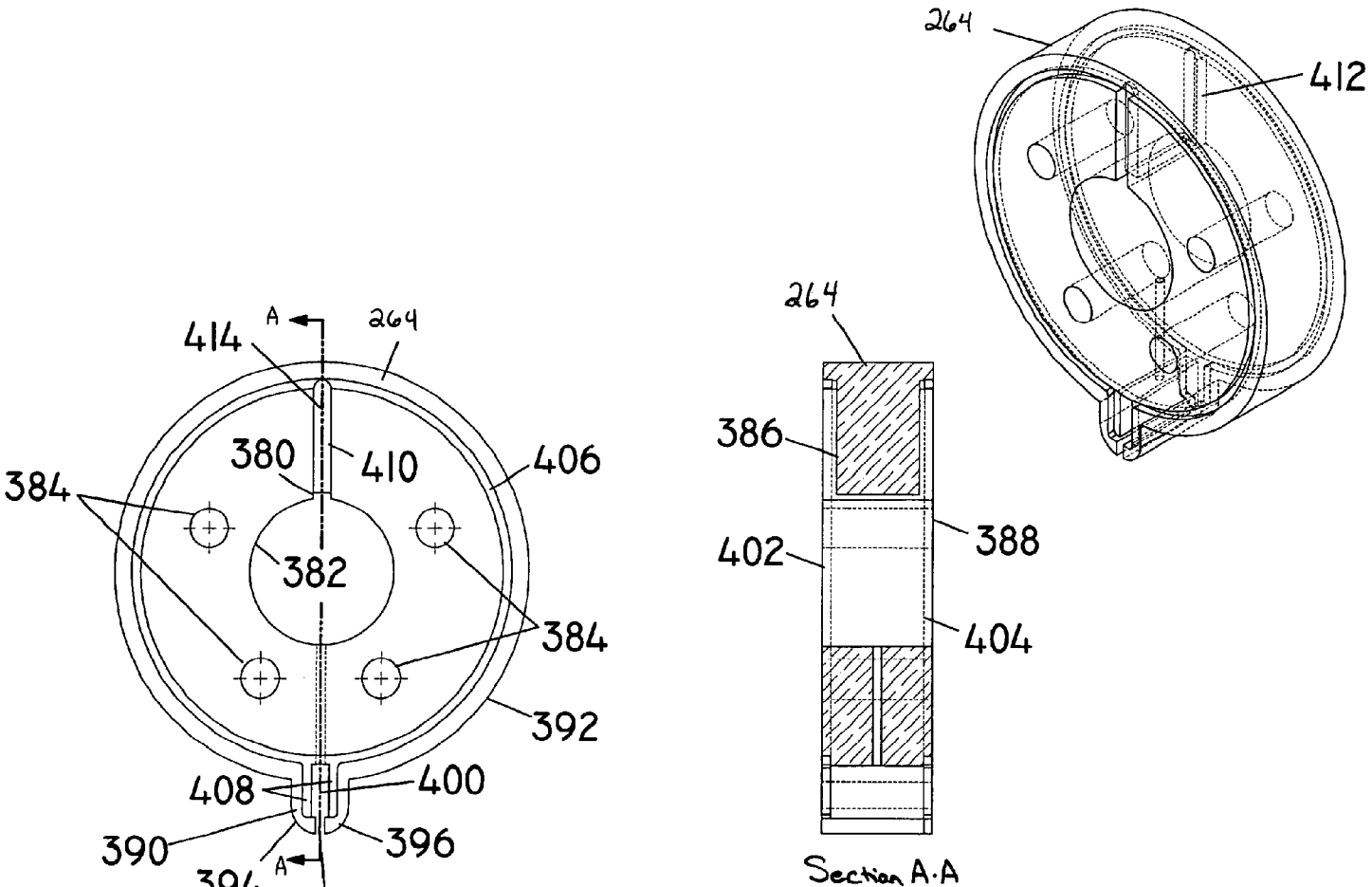
FIG. 19 depicts several views of one component depicted in FIG. 3.

The male compression rotor 264 rotates with the male rotor shaft 265 within the male compression rotor cavity 136 of the compression rotor case 106. The male compression rotor 264 is secured to the male rotor shaft 265 with at least one key. As shown in FIGS. 15 and 19, a key 378 fits within a keyway 380 located on an inner surface 382 of the male compression rotor 264 and a keyway 381 in the outer surface 349 of the male rotor shaft 265. Additional keys and keyways are within the scope of the present invention. The male compression rotor 264 is free to rotate within the compression rotor case 106.

The male compression rotor 264 defines a plurality of channels 384 extending from a first side 386 of the rotor 264 to a second side 388 of the rotor 264. The channels 384 preferably are distributed about the rotor 264. The channels 384 function to balance the rotor 264 as the rotor 264 defines a blade 390 in its outer perimeter 392. Preferably, the blade 390 on the male compression rotor 264 is approximately 180 degrees from the position of the blade 354 on the male power rotor 262. The blade 390 is designed to mesh with the cavity 320 on the female compression rotor 256.

The blade 390 has a curvilinear first upstanding portion 394 and a curvilinear second upstanding portion 396. The upstanding portions 394, 396 define between them a cavity 398. A seal 400 is located within the cavity 398.

A first lubricant channel 402 extends about the outer perimeter 392 of the first side 386 of the male compression rotor 264. A second lubricant channel 404 extends about the outer perimeter 392 of the second side 388 of the male compression rotor 264. At least one seal 406 is located in both lubricant channels 402, 404.

The seal 406 preferably has two prongs 408. The prongs 408 extend into the cavity 398 defined by the upstanding portions 394, 396 of the blade 390.

A third lubricant channel 410, on the first side 386, extends from the first lubricant channel 402, preferably approximately opposite the blade 390, to the inner surface 382 of the male compression rotor 264. A fourth lubricant channel 412, on the second side 388, extends from the second lubricant channel 404, also preferably approximately opposite the blade 390, to the inner surface 382 of the male compression rotor 264. The inner surface 382 accepts the male rotor shaft 265. At least one seal 414 is located in both the third and fourth lubricant channels 410, 412.

The male compression rotor 264 and the female compression rotor 256 may be wider than the male power rotor 262 and the female power rotor 254. The wider nature of the compression rotors 256, 264 may assist the motor 100 in producing compressed air. The compressed air may be used as disclosed herein. Additionally, the compressed air may be delivered to storage tanks (not shown) on the vehicle. The compressed air may be selectively delivered to the motor 100, such as during ignition. In other words, stored compressed air can be delivered to the motor 100, through the power valve sleeve 194, to be mixed with fuel and ignited in the male power rotor cavity 212. Thus, an electric starter is not required to turn the motor 100 over during ignition.

A method of operating the motor 100 comprises the following: referring to FIG. 1, as the male compression rotor 264 rotates counterclockwise, the blade 390 and its seal 400 sweep past the intake channel 150 of the compression rotor case 106 and the blade 390 continues to move in a downward direction. This rotation draws air into the intake channel 150 and into the male compression rotor cavity 136 of the compression rotor case 106. Specifically, air is drawn into the intake area 416 defined between the cavity 136 and the rotor 264 by vacuum force created by the rotor 264 sweeping along the inside of the male compression rotor cavity 136.

Air that is located in front of the blade 390 begins to become compressed between the front of the blade 390, and the relatively fluid tight intersection of the male compression rotor 264 and the female compression rotor 256 and the male compression rotor cavity 136 in a compression area 418. The compressed air pushes the valve 160 located within the compression rotor case valve channel 156 into the channel 156.

Compressed air is permitted to enter into the valve channel 156 until the spring 168 biases the valve 160 closed. With the valve 160 closed, the compressed air cannot escape back into the male compression rotor cavity 136. The compressed air flows through the valve channel 156 into the compression rotor case channel 174, through the fluid channel 182 of the isolator plate 108, through the connector channel 184 in the isolator plate 108 and into the power valve sleeve 194.

Figure 20:
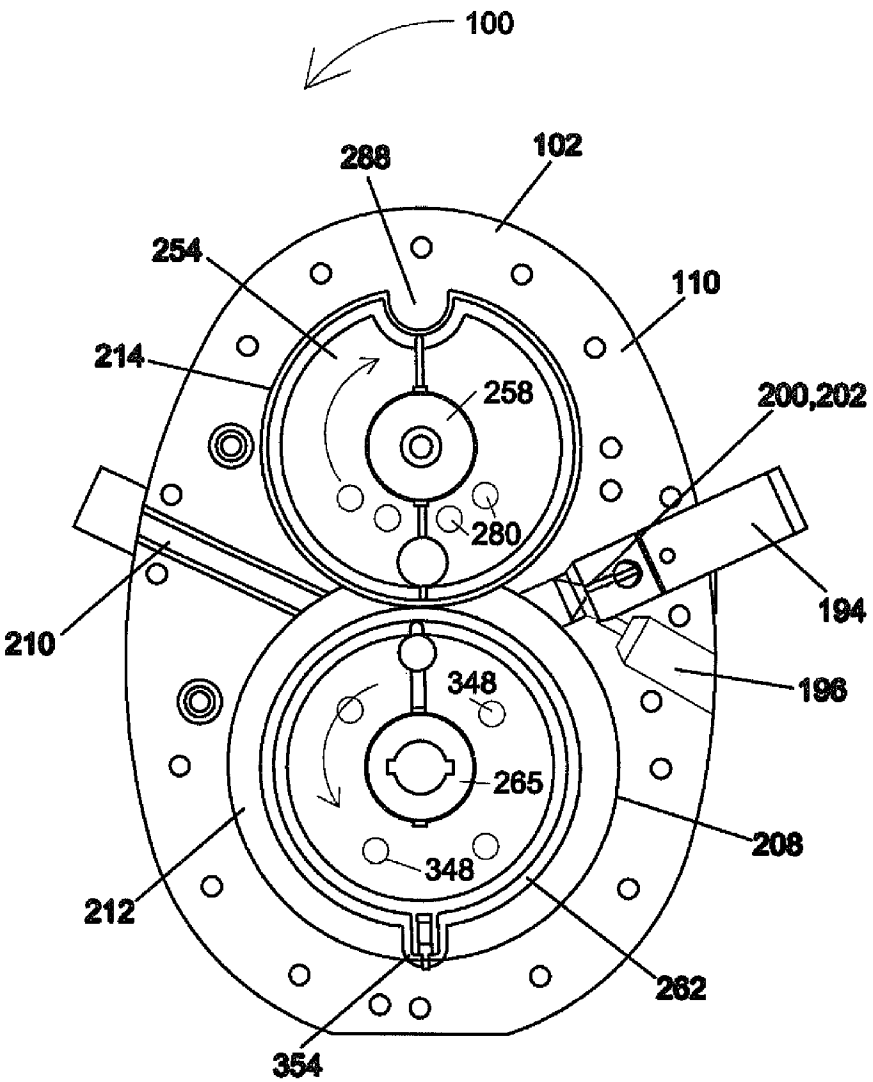
FIG. 20 depicts an end view of the invention.

Looking now at FIG. 20, which depicts the power valve sleeve 194 within the power rotor case 110, when the blade 354 on the male power rotor 262 is approximately in the 1:00 to 3:00 position, the sensor triggers the solenoid connected to the valve 200 within the power valve sleeve 194 to open, thus permitting the compressed air to flow into the male power rotor cavity 212 when the pressure ahead of the valve 194 is substantially equal to the pressure behind the valve 194, the value 194 closes. Preferably, substantially simultaneously, fuel is injected into the male power rotor cavity 212 via the fuel injector in the power valve sleeve 194 and the valve 194 closes. Contemporaneously, the spark plug 198 fires detonating the fuel/air mixture. The expanding gases from the detonation urge the male power rotor 262 in the counterclockwise direction as seen in FIG. 20. At substantially the same time, the exhaust gas from the last detonation is pushed out of the male power rotor cavity 212 into the exhaust channel 210.

While the above suggests that fuel can be injected substantially simultaneously with the introduction of air into the male power rotor cavity 212, the fuel can be added at any time.

It can be appreciated that air can be selectively injected into the male compression rotor cavity 212, that fuel can be selectively injected cavity and/or that the fuel air mixture can be selectively ignited, so that the power produced by the motor 100 can be varied.

Further, if the compressed air alone is delivered to the male compression rotor cavity 212, it has sufficient force that it can, by itself and without mixing and combustion with fuel, force the male power rotor 262 to turn. Thus, the motor 100 can be operated with compressed air.

Lubricant, such as oil, can be delivered through the oil galleys 122, 126, 230, 234 of the front housing plate 104 and/or the rear housing plate 112 to the various oil channels discussed above in the female power rotor 254, the female compression rotor 256, the male power rotor 262 and/or the male compression rotor 264. The oil may be used to radially extend the seals 368, 400 located between the upstanding portions 358, 260, 394, 396 of the blades 354, 390 of the male power rotor 262 and the male compression rotor 264. By radially extending and withdrawing the seals 268, 400, various degrees of contact, if any at all, are achieved with the male power rotor cavity 212 and the male compression rotor cavity 136. It can be appreciated that by varying the degree of contact between the seals 368, 400 and the walls of the cavities 212, 136, varying motor 100 compression and power can be achieved.

In accordance with the provisions of the patent statutes, the present invention has been described in what is considered to represent its preferred embodiments. However, it should be noted that the invention can be practiced otherwise than as specifically illustrated and described without departing from its spirit or scope

What is claimed is:

1. A motor, comprising:

a female rotor shaft having mounted thereon a female compression rotor, a female power rotor, and a spur gear;

a male rotor shaft having mounted thereon a male compression rotor, a male power rotor and a power rotor gear; and a housing having, in order, a front housing plate, a compression rotor case, an isolator plate, a power rotor case, a rear housing plate, each rotatably receiving therein said female rotor shaft and said male rotor shaft, said housing also having a gear cover adjacent said rear housing plate;

wherein said female compression rotor and said male compression rotor are rotatably mounted, and drivingly connected to one another, within a female compression rotor cavity and a male compression rotor cavity, respectively, within said compression rotor case;

wherein said female power rotor and said male power rotor are rotatably mounted, and drivingly connected to one another, within a female power rotor cavity and a male power rotor cavity, respectively, within said power rotor case;

wherein said spur gear and said power rotor gear are rotatably mounted, and drivingly connected to one another, within said gear cover.

* * * * *